US007832205B2

(12) United States Patent
Ruehle

(10) Patent No.: US 7,832,205 B2
(45) Date of Patent: Nov. 16, 2010

(54) DEFLECTOR STYLE EXHAUST MANIFOLD

(75) Inventor: Edward A. Ruehle, Plymouth, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 732 days.

(21) Appl. No.: 11/761,054

(22) Filed: Jun. 11, 2007

(65) Prior Publication Data

US 2008/0302095 A1 Dec. 11, 2008

(51) Int. Cl.
*F01N 1/00* (2006.01)

(52) U.S. Cl. ..... 60/323; 60/324

(58) Field of Classification Search ..... 60/313, 60/322, 323, 324; 29/890.052, 890.08
See application file for complete search history.

(56) References Cited

U.S. PATENT DOCUMENTS 1,761,960 A 6/1930 Armitage
2,230,666 A 2/1941 Martin
4,288,988 A 9/1981 Curtil
5,829,429 A 11/1998 VanRens
5,860,278 A 1/1999 Rodenkirch
6,324,838 B1 12/2001 Stempien
6,962,048 B2 11/2005 Ashida et al.
7,171,805 B2 2/2007 Ruehle
2005/0115231 A1* 6/2005 Ashida et al. ..... 60/313

* cited by examiner

*Primary Examiner*—Thomas E Denion
*Assistant Examiner*—Audrey Klasterka
(74) *Attorney, Agent, or Firm*—Ralph E. Smith

(57) ABSTRACT

An exhaust manifold for an engine having at least one combustion chamber and multiple exhaust valves arranged on a first plane is provided with a housing formed to provide a longitudinally extending main exhaust gas passage on a second plane terminating in an outlet at one end. A plurality of discrete, laterally spaced, inlet branch passages include a floor and a ceiling which are initially level with the exhaust valve for a distance equal to one-half the width of the inlet branch passage prior to sloping downward toward the main exhaust gas passage. One of the inlet branch passages is positioned at an end of the housing opposite the exhaust gas passage outlet. The remaining inlet branch passages include integrally formed deflector members arranged to provide an angular change of flow direction requiring exhaust gas to enter the main exhaust gas passage in the downstream direction.

13 Claims, 3 Drawing Sheets

DEFLECTOR STYLE EXHAUST MANIFOLD

FIELD OF THE INVENTION

The present invention relates to an improved exhaust manifold for controlling combustion gases and more particularly to arrangements for reducing pneumatic interaction between cylinders and optimizing exhaust flow in an exhaust manifold.

BACKGROUND OF THE INVENTION

Prior to the present invention, various exhaust manifolds and methods of controlling exhaust gases have been disclosed In the prior art. U.S. Pat. No. 2,230,666 which issued on Feb. 4, 1941 and is entitled "Exhaust Gas Collector" discloses a plurality of laterally spaced exhaust pipes fluidly connected to the cylinders of an associated internal combustion engine open to a diverging funnel-like main exhaust tube providing reduced back pressure and thereby increasing the power of the engine. U.S. Pat. No. 4,288,988 which issued on Sep. 15, 1981 and is entitled "Method and Apparatus for Improving the Gas Flow in an Internal Combustion Engine Exhaust Manifold" discloses a method and apparatus for damping pressure oscillations in the exhaust manifold of an associated engine by throttling the exhaust gas near the outlet of the cylinders and then accelerating the gas flow in the manifold by providing a uniform flow section therein which is substantially smaller than the cylinder bore. U.S. Pat. No. 5,860,278 which issued on Jan. 19, 1999 and is entitled "Apparatus and Method for Providing a Compact Low Pressure Drop Exhaust Manifold" discloses a method and apparatus for Improving flow through the manifold and decreasing pressure drop to enhance engine performance.

While these and other prior manifold constructions control flow of engine exhaust gas as disclosed, one drawback is that such constructions can result in exhaust interference (i.e. a portion of the engine exhaust gas reflected back up the exhaust tube toward non-firing upstream engine cylinders) and reduced output depending on the exhaust order of the engine cylinders. It is therefore desirable to provide an exhaust manifold that is capable of reducing undesirable pneumatic interaction between cylinders and optimizing exhaust flow.

One solution in the art for reducing undesirable pneumatic interaction is contained In U.S. Pat. No. 7,171,805 to Ruehle which issued on Feb. 6, 2007 and is entitled "Deflector Style Exhaust Manifold", wherein it is disclosed to provide an exhaust manifold is shown comprising a housing with a generally rectangular outer wall and providing a longitudinally extending main exhaust gas passage terminating in an outlet at one end and a plurality of discrete inlet branch passages arranged to provide separate gas passages in fluid communication with an associated exhaust valve of an engine. An initial inlet branch passage and an inner wall of the housing are arranged to provide a ninety degree angular change of flow direction as exhaust gas exits an exhaust port and enters the main exhaust gas passage. The remaining inlet branch passages are arranged to provide a deflector member between each inlet branch passage and the main exhaust gas passage which provides an angular change of flow direction requiring exhaust gas to enter the main exhaust gas passage in the downstream direction.

However, the space restrictions within the engine compartment of the modern motor vehicle may require that the main exhaust gas passage and the engine's exhaust ports are not co-planar with each other. More specifically, it may be necessary to arrange the exhaust manifold to place the main exhaust gas passage on a plane lower than the engine's exhaust ports. In such an arrangement, the mere provision of a deflector member between each inlet branch passage and the main exhaust gas passage is not sufficient to prevent undesirable pneumatic interaction between cylinders. This pneumatic interaction can be even further aggravated when the engine exhaust port has a relatively flat floor compared to an exhaust port with a floor having a high pitched curvature. In such systems, the amount of exhaust gas accumulating near the top of the main exhaust gas pressure is even more pronounced. It is therefore desirable to provide an exhaust manifold that permits the main exhaust gas passage and the engine's exhaust ports to be in non-coplanar fluid communication with each other while reducing undesirable pneumatic interaction between cylinders.

SUMMARY OF THE INVENTION

Accordingly, one aspect of the present invention is to provide an exhaust manifold that is capable of reducing undesirable pneumatic interaction between cylinders and optimizing exhaust flow.

Another aspect of the present invention is to provide an exhaust manifold that permits the main exhaust gas passage and the engine's exhaust ports to be in non-coplanar fluid communication with each other while reducing undesirable pneumatic interaction between cylinders.

In accordance with the foregoing aspects of the invention, an exhaust manifold for an engine having at least one combustion chamber and multiple exhaust valves arranged on a first plane is shown comprising a housing formed to provide a longitudinally extending main exhaust gas passage on a second plane terminating in an outlet at one end. A plurality of discrete, laterally spaced, inlet branch passages are arranged to provide separate gas passages operatively connected to an associated exhaust valve of the engine. The inlet branch passages include a floor and a ceiling which are initially level with the exhaust valve for a distance equal to one-half the width of the inlet branch passage prior to sloping downward toward the main exhaust gas passage. One of the inlet branch passages is positioned at an end of the housing opposite the exhaust gas passage outlet, with an inner wail extending from the end inlet branch passage to the main exhaust gas passage to redirect the flow of exhaust gas exiting the associated exhaust port. The remaining inlet branch passages include integrally formed deflector members arranged to provide an angular change of flow direction requiring exhaust gas to enter the main exhaust gas passage in the downstream direction.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
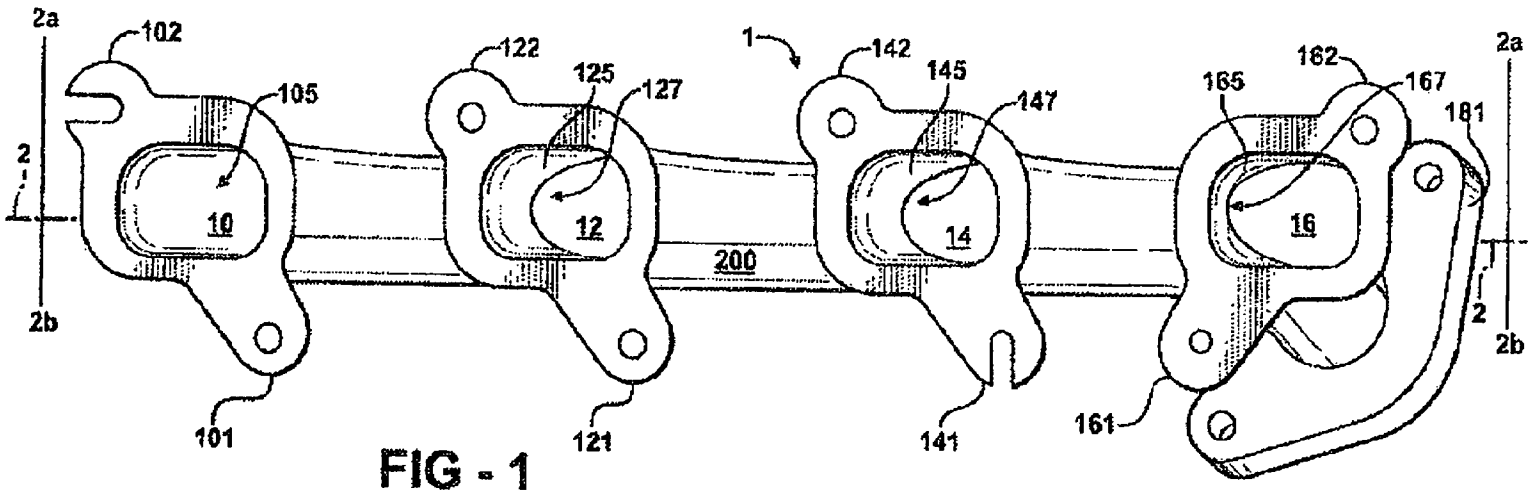
FIG. 1 shows an elevational side view of an exhaust manifold looking away from the engine cylinder head in accordance with the present invention.
Figure 3:
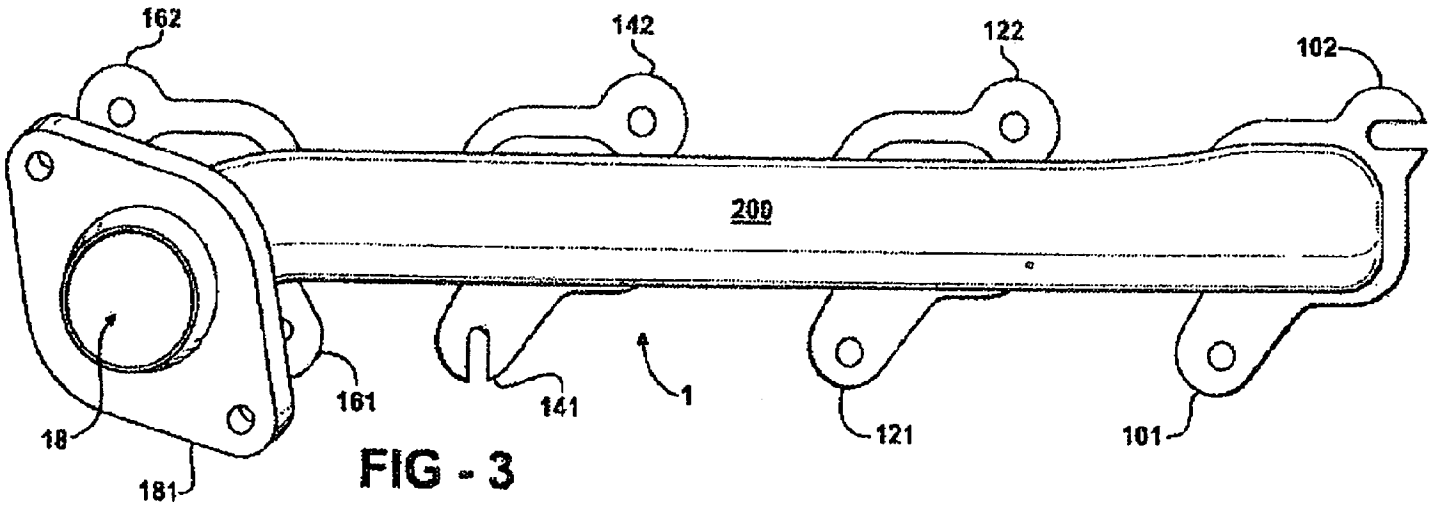
FIG. 3 shows an elevational side view of an exhaust manifold looking toward the engine's cylinder head in accordance with the present invention.

Turning now in greater detail to the drawings particularly FIGS. 1 and 3, an exhaust manifold 1 according to an exemplary embodiment of the invention adapted for use with an internal combustion engine is shown. In the illustrated embodiment, an exhaust manifold 1 is adapted to be attached to a right cylinder assembly of a V-8 type internal combustion engine (not shown). The exhaust manifold 1 consists of a plurality of coplanar exhaust gas inlet branch portions arranged in series and a main exhaust gas passage contained within a main housing 200 on a second lower plane which is arranged to be in fluid non-coplanar communication with the exhaust gas inlet branch portions of the manifold 1.

Figure 2A:
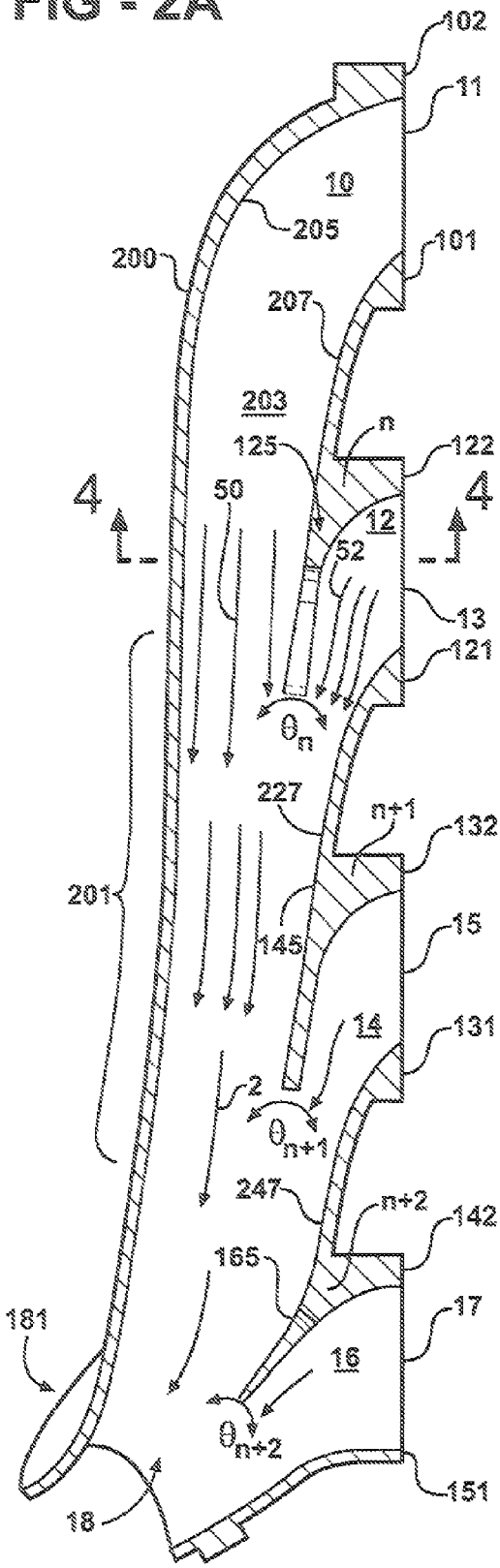
FIGS. 2A and 2B show a planer and sectional view of an exhaust manifold looking in the direction 2-2 shown in FIG. 1 in accordance with one embodiment of the present invention.
Figure 2B:
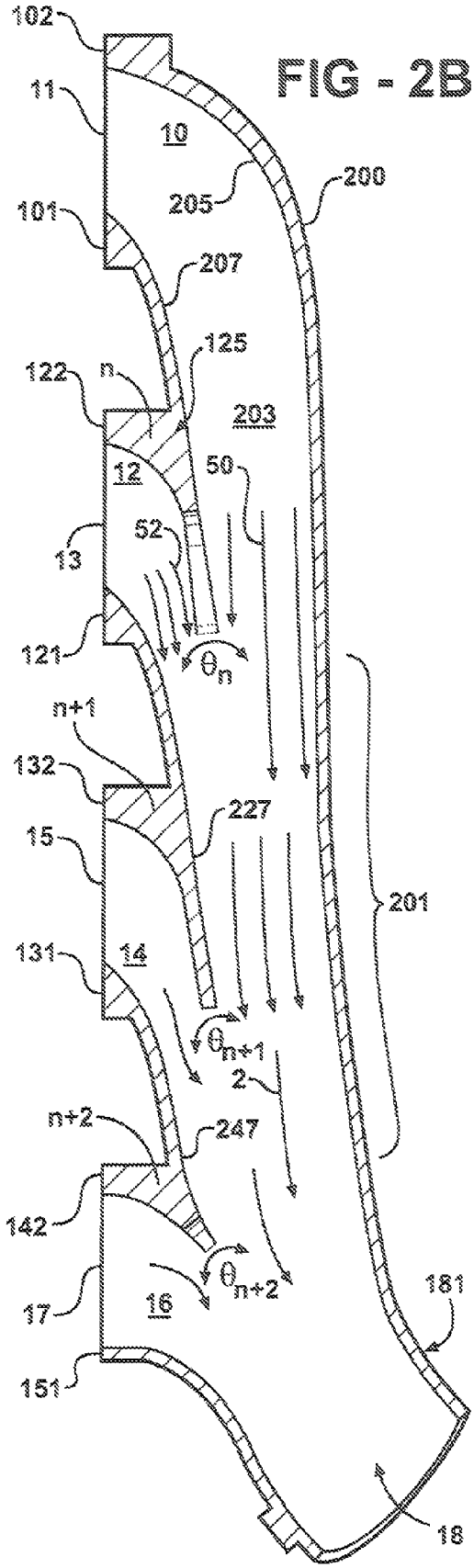
Figure 4:
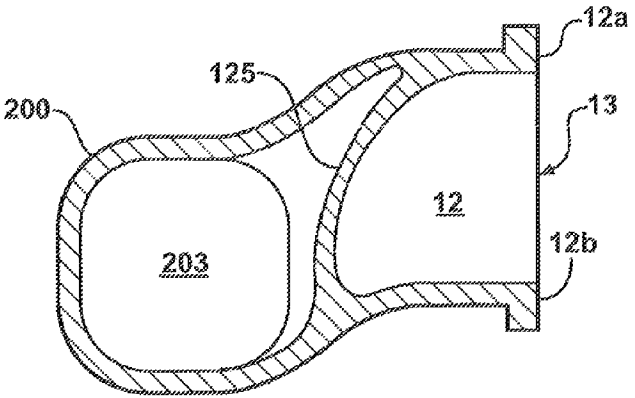
FIG. 4 shows a planer and sectional view of an exhaust manifold looking in the direction 4-4 shown in FIG. 1 in accordance with the present invention.

Referring to FIGS. 2A and 2B, each exhaust gas inlet branch portion defines an inlet branch passage 10, 12, 14 and 16, respectively, having exhaust gas openings 11, 13, 15 and 17 open to flow of exhaust gas from the passages of the cylinder head. The inlet branch passages 10, 12, 14 and 16 each receive a discharge of exhaust gas from an associated exhaust opening (not shown) of the engine cylinder head. As best shown in FIG. 4, the inlet branch passage 12 is formed to provide a runner with a ceiling 12A and floor 12B which is initially level with the plane of the exhaust valve for a distance equal to one-half the width of the inlet branch passage 12 prior to sloping toward the plane of the non exhaust gas passage 203. As a result of this arrangement, the evacuation features of the non-flowing inlet branch passages are preserved.

As best seen in FIG. 3, the housing 200 of the manifold 1 generally extends longitudinally with a closed forward end portion and an opened rearward end portion terminating in an outlet 18. When attached to the associated engine cylinder head, the manifold 1 is secured so as to align its inlet branch passages 10, 12, 14 and 16, respectively, with the outlet openings of the engine cylinder head. Specifically, the manifold 1 is attached to the cylinder head (not shown) by fasteners (not shown) extending through brackets 101, 102, 121, 122, 141, 142, 161 and 162. An encircling flange 181 is provided to connect the outlet 18 of the housing 200 to an exhaust pipe (not shown) by means of fasteners (not shown).

As best seen in FIGS. 2A and 2B, the main exhaust, gas passage 203 is defined by the internal walls 205, 207, 227 of the housing 200. As each exhaust valve opens for an associated combustion chamber, exhaust gas (such as 50 and 52 shown In FIGS. 2A and 2B) flows into the associated inlet branch passages 10, 12, 14 and 16 of the manifold 1 and into the main exhaust gas passage 203. The flow of exhaust gas through the initial inlet branch passage 10 into the main exhaust gas passage 203 of the manifold 1 will now be described.

With respect to inlet branch passage 10, the flow of exhaust gas performs an angular change of direction of approximately ninety degrees after the flow enters into the main exhaust gas passage 203. Each of the internal walls 205, 207 of the housing 200 are formed to gradually turn to provide this angular change of direction as the flow proceeds downstream in the longitudinal direction, as represented by arrows 2, toward the outlet end of the manifold 1.

In accordance with the present invention, deflector members 125, 145 and 165 are provided to prevent exhaust gases entering the main exhaust passage 203 from downstream inlet branch passages 12, 14 and 16 from backing up (i.e. flowing upstream) and pneumatically interacting with exhaust gases attempting to enter the main exhaust passage 203 from upstream inlet branch passages. More specifically, beginning at the side wall of each inlet branch passage 12, 14 and 16 upstream of the outlet end 18 of the manifold 1, deflector members 125, 145 or 165 are formed as a curved wall within housing 200 extending into main exhaust gas passage 203 from a respective inlet branch passage 12, 14 or 16. As shown in FIG. 4, the top portion of the deflector member 125 is curved away from the inlet branch passage 12 and arranged so a bottom portion of the deflector member 125 extends further into the main exhaust gas passage 203 than the top portion of the deflector member 125. This configuration counteracts the fact that the highest velocity air exists in the top portion of the exhaust inlet branch by pushing more flow towards the lower portion of the exhaust inlet branch and the main exhaust passage.

The terminal point of the deflector member 125 is shaped so that exhaust gas flow 50 from the upstream inlet branch passages can not flow past the deflector member 125 at any appreciable angle, and provides at least the same section area as an upstream inlet branch passage. As a result, the exhaust gas flow 50 enters the main exhaust gas passage 203 from exhaust passage at an angle $\theta_n$ relative to the main exhaust gas passage 203. As shown in FIGS. 2A and 2B, the deflector members n, n+1, and n+2 are arranged to protrude into the main exhaust gas passage 203 to create an angular change of flow direction caused by the deflector member n results in the exhaust gas 52 entering the main exhaust gas passage at an angle $\theta_n$ relative to the flow of exhaust gas 50 within the main exhaust gas passage 203 is less than ninety Degrees.

In a first exemplary embodiment of the present invention, three discrete inlet branch passages are provided so that the angular change of flow direction caused by the deflector members n and n+1 results In the exhaust gas 52 entering the main exhaust gas passage 203 at angles $\theta_n$ and $\theta_{n+1}$ relative to the flow of gas 50 within the main exhaust gas passage 203. In this exemplary embodiment, the relationship of the angular change of flow direction can be expressed as $\theta_n<\theta_{n+1}$.

In a second exemplary embodiment of the present invention, four discrete inlet branch passages are provided so that the angular change of flow direction caused by the deflector members n, n+1 and n+2 results in the exhaust gas 52 entering the main exhaust gas passage at angles $\theta_n$, $\theta_{n+1}$ and $\theta_{n+2}$ relative to the flow of gas 50 within the main exhaust gas passage 203. In this exemplary embodiment, the relationship of the angular change of flow direction can be expressed as $\theta_n<\theta_{n+1}<\theta_{n+2}$.

Figure 5:
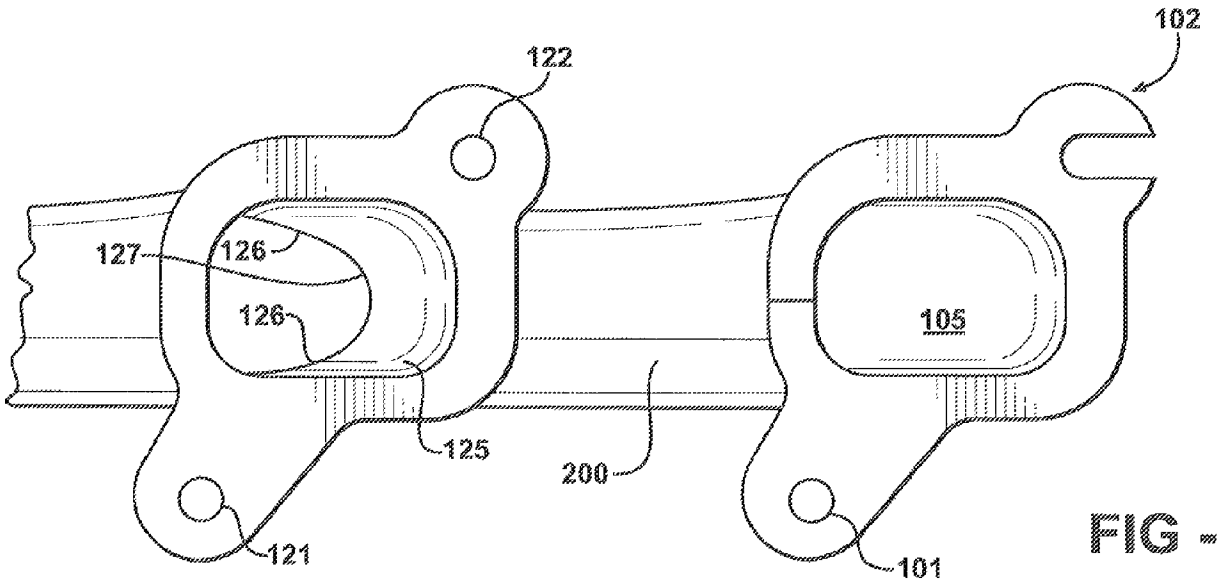
FIG. 5 shows a partial side view of an exhaust manifold looking away from the engine's cylinder head in accordance with the present invention.

Finally, as shown in FIG. 5, the deflector member 125 is formed with an inwardly sloping, or ramped, end surface, wherein the top and bottom portions of the wail 126 extend further into the main exhaust passage 203 than the middle section of the wall 127. Such an arrangement can mitigate the potential formation of cracks in the deflector member 125 due to thermal stress.

Therefore, the present invention advantageously provides a deflector member 125 is that controls any pressure waves from a downstream exhaust gas inlet branch by redirecting the flow from an inlet to be in the general direction of the main exhaust gas flow as it reaches the main exhaust gas passage 203. Thus, exhaust gases can not reach the opening of any non-flowing inlet branch passage, irrespective of its sequential or mechanical position, thus reducing the probability of cylinder to cylinder pneumatic interaction.

Another advantage of this deflector member 125 is the creation of a low-pressure area at the inlet branch passage/main exhaust passage juncture at each of the non-flowing inlet branch passages. As the upstream exhaust gas flow 50 passes by the outside surface of the deflector member 125, a low pressure area is naturally created on the opposite side of the deflector member 125. Since it is directionally correct for the cylinders' exhaust cycle to enter the manifold 1 at the lowest possible conduit pressure, the deflector member 125 assists in the optimization of the exhaust gas flow within the manifold 1.

While only the exhaust manifold 1 associated with the right cylinder head (not shown) has been shown and referred to in FIG. 1 and the text above, a similar left manifold would be provided for the left cylinder head of the V-8 engine. Other engines such as an I-4 (in-line four cylinder), or an I-6 engine would have only one single bank of cylinders and one cylinder head so that only a single exhaust manifold would be required. However, those skilled in the art will recognize that the specific exhaust gas control principles and construction of the exhaust manifold are applicable to other engine configurations.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An improved exhaust manifold for an engine having at least one combustion chamber and at least one exhaust valve for each such combustion chamber, said at least one exhaust valve arranged on a first plane, comprising;

a housing formed to provide a longitudinally extending main exhaust gas passage terminating in an outlet at one end thereof, said main exhaust gas passage arranged on a second plane lower than said first plane;

a plurality of discrete inlet branch passages formed in said housing laterally spaced from one another and arranged to provide separate gas passages operatively connected to an associated exhaust valve of said engine, said inlet branch passages having a floor and a ceiling which are initially level with said first plane of said exhaust valve for a distance equal to one-half the width of said inlet branch passage prior to sloping downward toward said second plane of said main exhaust gas passage;

a plurality of laterally spaced and radially extending exhaust gas openings in said housing and arranged to pneumatically connect said separate gas passages of said inlet branch passages to said main exhaust gas passage; said exhaust gas openings disposed in series along the length of one side of said housing;

one of said plurality of inlet branch passages and its associated exhaust gas opening positioned at an end of said housing opposite said exhaust gas passage outlet, said housing having an inner wall extending from the end inlet branch passage to said main exhaust gas passage to redirect the flow of exhaust gas exiting said associated exhaust valve and entering said main exhaust gas passage; and the other inlet branch passages of said plurality of exhaust gas inlet branch passages having an integrally formed deflector member (n) positioned between said exhaust gas opening and said main exhaust gas passage, wherein said deflector member (n) is arranged to provide an angular change of flow direction requiring exhaust gas to enter the main exhaust gas passage in the downstream direction;

wherein at least one deflector member (n) extends longitudinally across an entire length of said corresponding exhaust gas opening such that a portion of said at least one deflector member (n) extends longitudinally beyond said corresponding exhaust gas opening in the downstream direction.

2. The improved exhaust manifold of claim 1 wherein said angular change of flow direction caused by said deflector member results in said exhaust gas entering the main exhaust gas passage at an angle ($\theta_n$) relative to said flow of gas within main exhaust gas passage that is less than ninety degrees.

3. The improved exhaust manifold of claim 1 wherein said deflector member comprises a wall within said housing having a top portion which is curved away from said inlet branch passage and arranged so a bottom portion of said deflector member extends further into said main exhaust gas passage than said top portion of said deflector member.

4. The improved exhaust manifold of claim 1 wherein said at least one deflector member (n) comprises two deflector members.

5. The improved exhaust manifold of claim 1, wherein said first and second planes are parallel to each other.

6. The improved exhaust manifold of claim 1 wherein the plurality of discrete inlet branch passages is three passages and the angular change of flow direction caused by said deflector members (n) and (n+1) results in said exhaust gas entering said main exhaust gas passage at angles ($\theta_n$) and ($\theta_{n+1}$) relative to said flow of gas within said main exhaust gas passage.

7. The improved exhaust manifold of claim 6 wherein the relationship of said angular change of flow direction can be expressed as $(\theta_n)<(\theta_{n+1})$.

8. The improved exhaust manifold of claim 1 wherein the plurality of discrete inlet branch passages is four passages and the angular change of flow direction caused by said deflector members (n), (n+1) and (n+2) results in said exhaust gas entering said main exhaust gas passage at angles ($\theta_n$), ($\theta_{n+1}$) and ($\theta_{n+2}$) relative to said flow of gas within said main exhaust gas passage.

9. The Improved manifold of claim 8 wherein the relationship of said angular change of flow direction can be $(\theta_n)<(\theta_{n+1})<(\theta_{n+2})$.

10. The improved exhaust gas manifold of claim 8 wherein said deflector members (n) and (n+1) each extend longitudinally across an entire length of a respective corresponding exhaust gas opening such that a portion of each of deflector members (n) and (n+1) extends longitudinally beyond said respective corresponding exhaust gas openings in the downstream direction; and wherein said deflector member (n+2) extends longitudinally across only a portion of said respective corresponding exhaust gas opening.

11. The improved exhaust manifold of claim 1 wherein said deflector member comprises a wall with an end formed as a ramped surface.

12. The improved exhaust manifold of claim 11, wherein said ramped surface of said end of said deflector member wall includes a top section, a bottom section and a middle section therebetween, said top and bottom sections extending further into said main exhaust gas passage than said middle section.

13. The improved exhaust manifold of claim 12, wherein said top, bottom and middle sections of said ramped surface form a concave configuration in the end of said deflector member wall.

* * * * *